United States Patent [19]

Celli

[11] Patent Number: 4,953,715

[45] Date of Patent: Sep. 4, 1990

[54] BOOT SUPPORT

[76] Inventor: Giuliano Celli, 95 Wakelin Ct., Woodbridge, Ontario, Canada, L4L 1A9

[21] Appl. No.: 389,415

[22] Filed: Aug. 4, 1989

[51] Int. Cl.[5] ..... A47F 7/00

[52] U.S. Cl. ..... 211/37; 211/34; 248/297.5

[58] Field of Search ..... 211/37, 34, 107, 209, 211/193, 204; 248/125, 316.7, 316.8, 309.1, 297.5

[56] References Cited

U.S. PATENT DOCUMENTS

| | | | |
|---|---|---|---|
| 446,312 | 2/1891 | Wikle | 211/34 X |
| 2,943,899 | 7/1960 | Beller | 211/34 X |
| 3,286,845 | 11/1966 | Meyer et al. | 211/34 |
| 3,295,812 | 1/1967 | Schneider et al. | 248/297.5 X |

FOREIGN PATENT DOCUMENTS

| | | | |
|---|---|---|---|
| 909722 | 9/1972 | Canada | 211/37 |
| 2226890 | 11/1974 | France | 248/297.5 |

*Primary Examiner*—Robert W. Gibson, Jr.

[57] ABSTRACT

A boot support comprises a base, an upright portion extending generally perpendicular to the base and supported thereby, and a cantilevered arm slidable on the upright portion at one end of the arm. The arm is biased by gravity to lock with the upright portion but may have the free end thereof moved to be generally perpendicular such that the arm freely slides. The arm at the end remote from the upright portion includes a releasable clip adapted to engage a boot at the top of the boot and has sufficient gripping force to maintain two boots suspended from the clip means. The weight of the boots further serves to lock the cantilevered arm in a non-sliding position, whereby the support effectively suspends the boots.

17 Claims, 2 Drawing Sheets

BOOT SUPPORT

BACKGROUND OF THE INVENTION

The present invention relates to a boot support particularly for womens' leather boots of a height to cover a womans' calf. In particular, the boot support is adapted to suspend womens' boots of this type to keep the boots in a more orderly fashion and to reduce the possibility of damage to the boots.

Boots in the retail outlets are normally displayed in a flat condition with one boot laid on another, or are suspended from a display rack which has a host of fixed clips. In some circumstances the boots may be placed in an upright condition, but they normally tend to bend intermediate their heights and either strike another boot or end up flat on the floor.

Boots of this type are relatively expensive and can be made of high quality leather. In winter the boots are removed upon entering the vestibule of a premise and will often fall and can become soiled due to dirt or salt that may have been on the treads of those boots or other boots. The structure of the present invention provides a simple inexpensive support arrangements, where boots may be suspended to avoid damage and to also provide a more orderly boot storage system.

SUMMARY OF THE INVENTION

A boot support according to the present invention comprises a base, an upright portion extending generally perpendicular to the base adjacent one edge of the base and a cantilevered arm slidable on the upright portion at one end of the arm. The arm is biased by gravity to lock with the upright portion under the influence of the weight of the arm and the arm at the end remote from the upright portion includes a releasable clip means adapted to engage a boot at the top thereof. The gripping force of the clip means is sufficient to maintain two boots suspended therefrom.

According to an aspect of the invention, the cantilevered arm includes a collar slidable about the circumference of the upright and lockable with the upright due to a wedging action resulting from the moment applied to the collar by the arm.

According to a further aspect of the invention, the upright portion and a base portion are separable for convenience of shipping and off season storage.

BRIEF DESCRIPTION OF THE DRAWINGS

Preferred embodiments of the invention are shown in the drawings wherein.

DETAILED DESCRIPTION OF THE PREFERRED EMBODIMENTS

Figure 1:
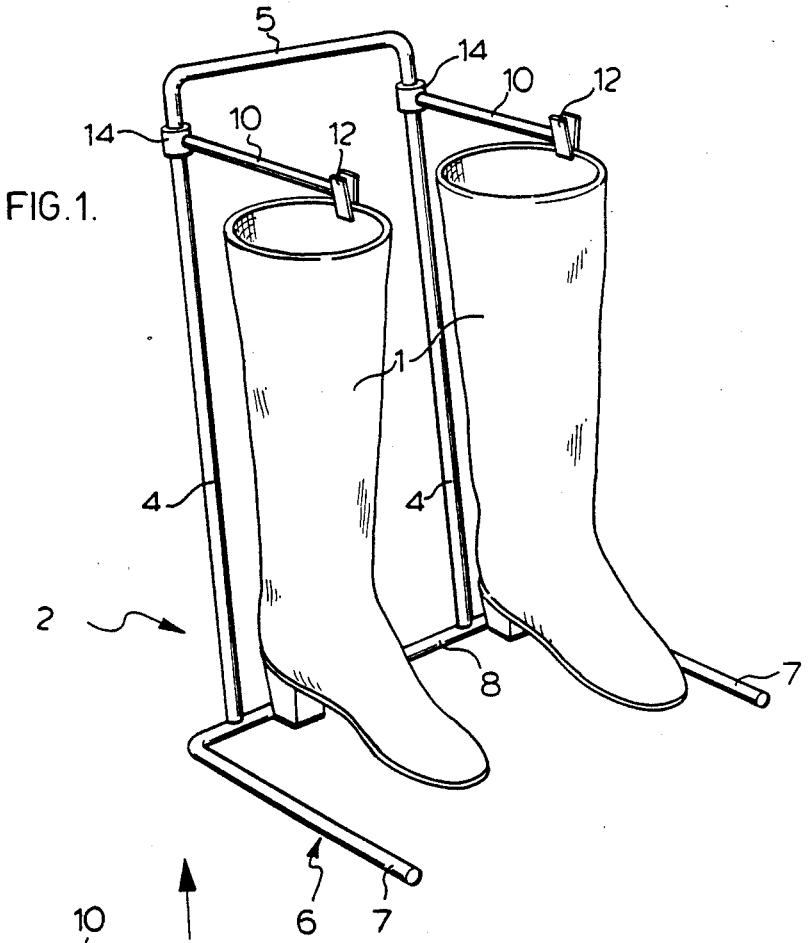
FIG. 1 is a perspective view of the boot support.

For clarity and to more clearly show the various components of the boot support, only one boot has been shown suspended from each cantelevered arm 10 of the boot support 2. The spring clips 12 have sufficient strength for suspending two boots from each clip, and this is the preferred operation. Each cantilevered arm

10 at the end remote from the clip 12 has a collar portion 14 which is slidable on the upright portion 4. In the preferred embodiment shown in the figures, the boot support has two upright portions 4 interconnected by a top section 5 to form one intregal unit. This intregal unit is secured to the base 6 having feet portions 7 at either end of an intermediate portion 8. The connection of the uprights 4 to the intermediate portion 8 is accomplished due to studs extending from the upper surface of the intermediate portion 8 with the studs generally shown as 16 in FIG. 2. There is one stud associated with each upright portion and the upright portion is adapted to slide thereover and provide a snug fit therewith.

Figure 2:
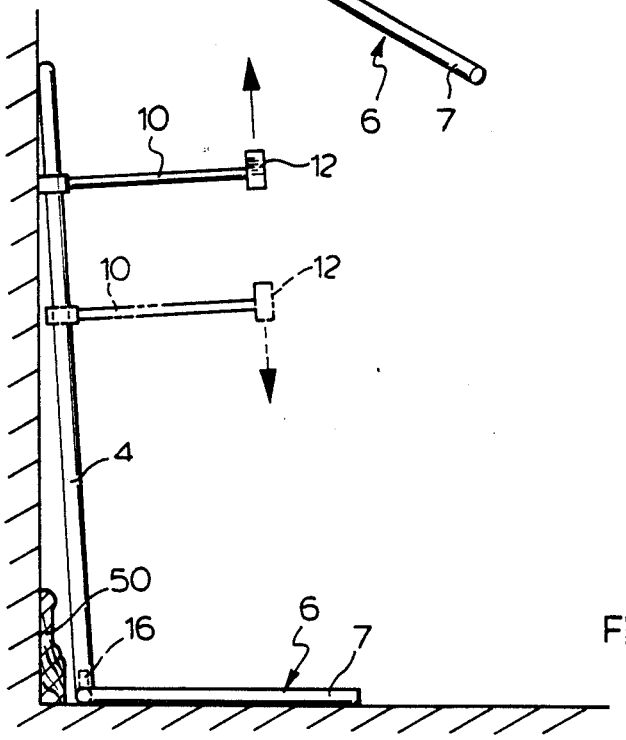
FIG. 2 is a side elevation of the boot support positioned adjacent a wall.
Figure 4:
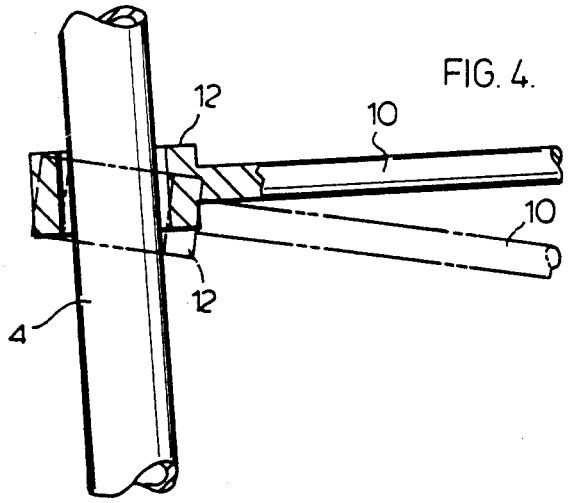
FIG. 4 is a partial perspective view showing a portion of the upright, and the portion of a cantelevered arm and the locking aspect of the arm relative to the upright.

As can be seen in FIG. 2, each cantilevered arm 10 can slide along the associated upright portion 4 by positioning the arm 10 generally perpendicular to the upright portion 4 at which point the collar is easily slidable along the upright portion. As soon as the arm has been appropriately been positioned, release thereof causes a slight downward angling of the arm 10, which effectively locks the collar to the upright portion due to a wedging action as generally shown in FIG. 4. This wedging action is sufficient to maintain the lock engagement when two boots of the type shown generally as 1 in FIG. 1 are suspended from the clip 12.

The boot support is directed to home use, although it need not be so limited, and as such, has been adapted to accommodate a base board generally shown as 50 in FIG. 2. The upright 4 is angled slightly rearwardly from the feet 6, and as such, is not quite vertical. This rearward angulation makes the device somewhat more stable and also allows the connecting portion 5 to come in contact with the wall or at least closely come in contact with the wall. Otherwise, this portion 5 would be spaced from the wall, at least the thickness of the base board 50.

Figure 3:
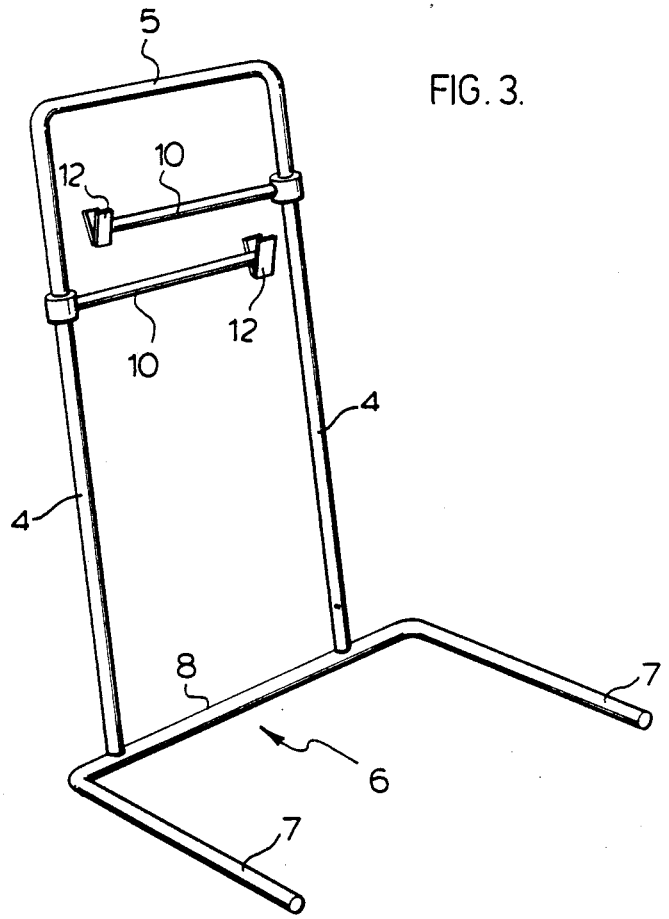
FIG. 3 is a perspective view of the boot support with the cantelever arms rotated to a storage position.

When the device is not in use or temporarily not in use, the cantilevered arms 10 may be swung to the storage position, generally shown in FIG. 3. In this position, the arms 10 are intermediate the two upright portions 4 and as such provide quite a clear region whereby the boot support is unobtrusive.

The snap connection of the upright portions 4 with the intermediate portion 8 due to the studs 16 being received within the hollow centers of the uprights 4, allows the device to be placed in a storage position by removing the uprights 4 from the studs, thus allowing the entire structure to be stored in a relatively flat condition. This would be done for example, for summer storage, if not needed and for packaging. The device can also be used for off season effecient storage of boots in a manner to avoid damage of the boots.

The spacing of the feet 6 either side of the studs 16 allows boot supports to be placed in series along a wall with generally equal spacing between arms placed for suspending boots. This generally implies the spacing between the uprights in twice the spacing of said feet from the closest upright.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A boot support comprising a base, an upright portion extending generally perpendicular to the base adjacent one edge of said base and a cantilevered arm slidable on said upright portion at one end of said arm and biased by gravity to lock with said upright portion under the influence of the weight of said arm, said arm at an end remote from said upright portion including a releasable clip means adapted to engage a boot at the top thereof and have sufficient gripping force to maintain two boots suspended from the clip means, and two upright portions spaced from one another and joined at the upper end to be integral, said upright portions being angled slightly from the vertical rearwardly away from said base with each upright including a single cantilevered arm.

2. A boot support as claimed in claim 1, wherein said cantilevered arm includes a collar which receives said upright portion and is slidable therealong and lockable with said upright portion.

3. A boot support as claimed in claim 1, wherein said upright portions and said base are of a tubular section, and said base includes stubs extending therefrom which are received in said uprights and form a releasable connection between said base and said upright portions.

4. A boot support as claimed in claim 3, wherein said base has two extending feet on either side of said upright portions and an intermediate generally straight back portion connecting said feet and having said studs thereon said feet extending to the same side of said back portion.

5. A boot support as claimed in claim 4, wherein said back portion and said feet are formed as a single piece.

6. A boot support as claimed in claim 5, wherein all components are of a plastic material.

7. A boot support as claimed in claim 5, wherein said cantilevered arms are rotatable from a storage position generally intermediate said upright portions to an operative position approximately 90 degrees to the storage position.

8. A boot support as claimed in claim 7, wherein said upright portions are centered either side of the centerpoint of said back portion and equal distance and said feet are positioned beyond an adjacent upright portion the same distance as each upright is spaced from said centerpoint.

9. In combination, a boot support and at least one boot, said boot support comprising a base, an upright portion extending generally perpendicular to the base adjacent one edge of said base and a cantilevered arm slidable on said upright portion at one end of said arm and biased by gravity to lock with said upright portion under the influence of the weight of said arm, said arm at an end remote from said upright portion including a releasable clip means adapted to engage a boot at the top thereof and have sufficient gripping force to maintain two boots suspended from the clip means, said at least one boot being secured within said clip means and said arm being positioned on said upright to suspend said at least one boot from said clip means.

10. In combination as claimed in claim 9, wherein said cantilevered arm includes a collar which receives said upright portion and is slidable therealong and lockable with said upright portion.

11. In combination as claimed in claim 9, wherein said boot support includes two upright portions spaced from one another and joined at the upper end to be integral, said upright portions being angled slightly from the vertical rearwardly away from said base with each upright including a single cantilevered arm.

12. In combination as claimed in claim 11, wherein said upright portions and said base are of a tubular section, and said base includes stubs extending therefrom which are received in said uprights and from a releasable connection between said base and said upright portions.

13. In combination as claimed in claim 12, wherein said base has two extending feet on either side of said upright portions and an intermediate generally straight back portion connecting said feet and having said studs thereon said feet extending to the same side of said back portion.

14. In combination as claimed in claim 13, wherein said back portion and said feet are formed as a single piece.

15. In combination as claimed in claim 14, wherein all components are of a plastic material.

16. In combination as claimed in claim 14, wherein said cantilevered arms are rotatable from a storage position generally intermediate said upright portions to an operative position approximately 90 degrees to the storage position.

17. In combination as claimed in claim 16, wherein said upright portions are centered either side of the centerpoint of said back portion and equal distance and said feet are positioned beyond an adjacent upright portion the same distance as each upright is spaced from said centerpoint.

* * * * *